US007526907B2

(12) United States Patent
Bostock

(10) Patent No.: US 7,526,907 B2
(45) **Date of Patent: *May 5, 2009**

(54) SAFETY STIRRUP

(75) Inventor: Hayden Bostock, Camberwell (AU)

(73) Assignee: Bostock Developments Pty Ltd, Melbourne (AT)

( * ) Notice: Subject to any disclaimer, the term of this patent is extended or adjusted under 35 U.S.C. 154(b) by 0 days.

This patent is subject to a terminal disclaimer.

(21) Appl. No.: 11/615,813

(22) Filed: Dec. 22, 2006

(65) Prior Publication Data

US 2007/0157584 A1 Jul. 12, 2007

Related U.S. Application Data

(63) Continuation-in-part of application No. 10/756,832, filed on Jan. 12, 2004, now abandoned, which is a continuation-in-part of application No. 10/048,078, filed as application No. PCT/AU00/00867 on Jul. 20, 2000, now Pat. No. 6,698,169.

(30) Foreign Application Priority Data

Jul. 23, 1999 (AU) ..... PQ1803

(51) Int. Cl.
*B68C 3/00* (2006.01)

(52) U.S. Cl. ..... 54/49

(58) Field of Classification Search ..... 54/47, 54/49

See application file for complete search history.

(56) References Cited

U.S. PATENT DOCUMENTS

| | | | |
|---|---|---|---|
| 29,953 | A | 9/1860 | Clark |
| 49,103 | A | 8/1865 | Gould |
| 163,120 | A | 5/1875 | Waggoner |
| 219,608 | A | 9/1879 | Updegraff |
| 332,052 | A | 12/1885 | Coates |
| 341,987 | A | 5/1886 | Allen |
| 368,193 | A | 8/1887 | Collins |
| 396,179 | A | 1/1889 | Taylor |
| 408,944 | A | 8/1889 | Welcome |
| 445,411 | A | 1/1891 | Pearson et al. |
| D20,746 | S | 5/1891 | Moulton |
| 498,953 | A | 6/1893 | Cornelius |
| 499,283 | A | 6/1893 | Crone |
| 535,870 | A | 3/1895 | Taylor |
| D32,254 | S | 11/1900 | Goodman |
| 717,850 | A | 1/1903 | Crozier |
| 755,531 | A | 3/1904 | Parrish |

(Continued)

FOREIGN PATENT DOCUMENTS

| | | |
|---|---|---|
| AU | 574437 | 7/1988 |

(Continued)

*Primary Examiner*—Son T. Nguyen
(74) *Attorney, Agent, or Firm*—Sherdan Ross P.C.

(57) ABSTRACT

The invention provides a two-way safety stirrup that will release in the event of the rider being dismounted but which is less prone to unexpected release when pressure is applied in the forward direction. The safety stirrups are of far simpler construction than stirrups of the prior art, yet are not as prone to unexpected release and can be made of non-metal materials, such as plastics and polymers, so that the stirrups are more economically manufactured and are of comparatively light weight.

9 Claims, 7 Drawing Sheets

U.S. PATENT DOCUMENTS

| | | | | |
|---|---|---|---|---|
| 877,062 | A | | 1/1908 | Easterwood |
| 887,510 | A | | 5/1908 | Parks |
| 902,745 | A | | 11/1908 | Krieg |
| 908,265 | A | | 12/1908 | Ivey |
| 932,574 | A | | 8/1909 | Putney |
| 975,164 | A | | 11/1910 | Samson |
| 1,000,782 | A | | 8/1911 | Cox |
| 1,025,824 | A | | 5/1912 | Myers |
| 1,052,327 | A | | 2/1913 | Eddleman |
| 1,088,552 | A | | 2/1914 | Dolan |
| 1,104,216 | A | | 7/1914 | Ostwald |
| 1,111,731 | A | | 9/1914 | Boyd et al. |
| 1,276,540 | A | | 8/1918 | Kall |
| 1,314,992 | A | | 9/1919 | Wallis |
| 1,321,653 | A | | 11/1919 | Luttinger |
| 1,392,673 | A | | 10/1921 | Baker |
| 1,480,314 | A | | 1/1924 | Szymanski |
| 1,622,510 | A | | 3/1927 | Hendriks |
| D125,436 | S | | 2/1941 | Talbert |
| 2,641,883 | A | | 6/1953 | Evans |
| 3,423,904 | A | * | 1/1969 | Stubblefield ..... 54/49 |
| 3,910,015 | A | | 10/1975 | Ebejer |
| 4,209,962 | A | | 7/1980 | Forest |
| D292,628 | S | | 11/1987 | Racina |
| 4,995,226 | A | | 2/1991 | Kuhn, Jr. |
| 5,826,413 | A | | 10/1998 | Bostock et al. |
| D415,594 | S | | 10/1999 | Bostock |
| D415,862 | S | | 10/1999 | Bostock |
| D417,038 | S | | 11/1999 | Bostock |
| D429,389 | S | | 8/2000 | Bostock |
| 6,698,169 | B1 | | 3/2004 | Bostock |

FOREIGN PATENT DOCUMENTS

| | | |
|---|---|---|
| AU | 199062109 | 3/1991 |
| AU | 672737 | 10/1996 |
| AU | 199965521 | 7/2000 |
| DE | 2003387 | 7/1971 |
| DE | 2711834 | 9/1978 |
| DE | 3934810 | 10/1990 |
| EP | 0065714 | 12/1982 |
| GB | 2183437 | 6/1987 |
| WO | WO 97/49635 | 12/1997 |

* cited by examiner

SAFETY STIRRUP

CROSS REFERENCE TO RELATED APPLICATIONS

This application is a continuation-in-part of U.S. patent application Ser. No. 10/756,832, filed Jan. 12, 2004 now abandoned, which is a continuation-in-part of U.S. patent application Ser. No. 10/048,078, filed May 29, 2002, now U.S. Pat. No. 6,698,169, which is a National Phase filing under 35 U.S.C. § 371 of PCT AU00/00867 filed Jul. 20, 2000, which claims priority to Australian patent application PQ1803, filed Jul. 23, 1999, the entire disclosures of which are incorporated herein by this reference.

FIELD OF THE INVENTION

The present invention relates to a horse riding stirrup. In particular, the present invention relates to a safety stirrup which prevents the rider's foot being retained in the stirrup in the event of the rider being dismounted or thrown from the horse. More particularly, the present invention relates to a novel two-way release safety stirrup.

BACKGROUND OF THE INVENTION

Stirrups are well known in the prior art and have been used for hundreds of years. In general, a stirrup includes a D-shaped metal structure with a slot located in the center of the arcuate portion of the D-shaped structure for attachment of a stirrup strap, which in turn connects to a saddle. In use, the rider's foot is inserted into the D-shaped structure and the straight, base portion known as a footplate is located adjacent the sole of the rider's boot while the arcuate portion of the stirrup is located adjacent the upper of the rider's boot.

One of the problems associated with stirrups of the prior art is that if the rider is dismounted or thrown, they may not have sufficient time to withdraw their foot from the stirrup. Often the D-shaped structure fits firmly around the rider's boot, trapping the rider's foot. If the foot remains trapped in the stirrup, and the horse continues moving, the rider can be dragged along, often causing serious injury or death. Each year many people are injured or killed in this type of accident.

In order to overcome this well known problem, attempts have been made to provide safety stirrups that release the rider's foot if the rider is dismounted or thrown from the horse. One form of safety stirrup of the prior art includes a frangible or weakened portion adjacent the point where the stirrup is attached to the stirrup strap. If the rider is dismounted or thrown and their foot remains caught in the stirrup, the frangible portion breaks, releasing the stirrup from the stirrup strap. However this type of safety stirrup suffers from the drawback that it may break away from the stirrup strap during particularly hard riding, leaving the rider unbalanced, and unable to control the horse using his or her feet. Furthermore, the rider cannot re-mount until a new stirrup is fitted, which can be difficult or inconvenient if the stirrup breaks away in an isolated area. Furthermore, the frangible stirrup does not prevent leg injuries and is therefore of limited value for novice or disabled riders. A further disadvantage is that these stirrups are very bulky in the region where they attach to the stirrup strap and the increased bulk often causes excessive wear to the rider's clothing.

Another type of safety stirrup is disclosed in EP-0 065 714. This safety stirrup comprises a U-shaped release member supported at either end of the U within a D-shaped mounting member. During normal riding, the D-shaped mounting member and the U-shaped release member lie in the same plane. During normal riding, the sole of the rider's boot rests against the flat portion, or footplate, of the D-shaped member. If the rider is dismounted, the rider's foot causes the U-shaped release member to pivot out of the plane of the stirrup, concomitantly causing the footplate of the D-shaped mounting member to release at one end while the other end pivots away from the rest of the D-shaped mounting member. This allows the rider's foot to be released from the stirrup.

Other safety stirrups are described in AU-39229/95, U.S. Pat. No. 341,987 and DE-2003387. These safety stirrups also include articulated members that separate and release the rider's foot if the rider is dismounted or thrown. They all rely on forward or alternatively, backwards motion of the rider's foot as the rider is dismounted. However they are not specifically designed to release if the rider's foot moves upwards as he or she is dismounted, a common occurrence, particularly if the horse is bucking or jumping.

Another, quite different type of safety stirrup is described in U.S. Pat. No. 1,276,819. The stirrup comprises a pair of hingedly engaged, downwardly extending arms forming a U-shaped member, with the footplate hingedly engaged adjacent the end of one of the arms and releasably engaged adjacent the end of the other arm. The stirrup further comprises a vertically slideable plate, which in use rests against the upper of the rider's boot. If the rider's foot moves upwards, out of the normal in-use position, the plate slides upwards, activating a mechanism which causes one end of the footplate to release from one arm of the U-shaped member, thus releasing the rider's boot.

Yet another type of safety stirrup is disclosed in U.S. Pat. No. 1,321,653. This safety stirrup comprises a U-shaped mounting member having resilient, upturned arms that deform in response to strain. In this case, the foot support member has a lug portion that prevents it from upward movement, thus if the rider falls or is otherwise dismounted, the abnormal strain imposed on the stirrup causes the foot rest to disengage its keeper, the resilient arms of the U-shaped member deforming from the normal use position so that the foot rest can completely disengage from the arms.

Most safety stirrups can be classed as "one-way" release or "two-way" release stirrups. The "one-way" stirrup requires that the rider's foot be inserted in the stirrup in one particular direction or from one particular side if the release mechanism is to operate properly. Pressure exerted in the forward direction, that is, towards the rider's toe, will not cause the safety stirrup to release. Only pressure exerted in the rearward direction, that is, towards the rider's heel will cause the safety stirrup to release. Because the stirrup only opens up in one way or one direction, it is important that the rider's foot is inserted from the correct side of the stirrup, otherwise the release mechanism will not operate properly.

Conversely a "two-way" safety stirrup will release if pressure is exerted from either the forward or rearwards direction, hence the rider can place their foot in a two-way stirrup from either direction. For example a typical one-way safety stirrup is disclosed in AU-62109/90.

The safety stirrup of AU-62109/90 holds the rider's foot in a restraint that separates when the restraint is pivoted out of the normal position. International application PCT/AU97/00398 discloses another one-way safety stirrup. The safety stirrup of PCT/AU97/00398 also comprises a restraining means pivotally mounted between two extremities of an inverted U-shaped mounting means.

As mentioned above, when attached correctly to stirrup straps, the one way stirrups of the prior art release and open up only if the rider's foot pivots rearwards. Because they only open in the rearwards direction, they cannot open up if the rider's foot pivots forwards or pushes hard into the stirrup, as may occur as a result of very hard riding such as during a polo match or rodeo riding. While the one-way stirrup works well for all standards of riding including very hard riding, one-way stirrups of the prior art suffer from the disadvantage that they do not open up in response to certain types of riding accidents.

For example, a one way stirrup will not release if the rider's foot exerts strong forward pressure as the rider is thrown over the head of the horse, or to the side of the horse or in the course of jumping. Another problem with some designs of one-way stirrup of the prior art is that the rider's foot may still be retained within the U-shaped mounting means even when the restraint is pivoted out of the normal position and separates. Furthermore, as already mentioned, the correct operation of one-way stirrups is conditional on the stirrup being connected to the stirrup strap in one specific orientation, such that the rider's boot is inserted only in one particular direction into the stirrup. If the stirrup is oriented in the wrong direction it can release unexpectedly and lead to rider injury and/or loss of control of the horse. There is a risk that some riders, in particular novice riders, may unwittingly connect a one-way stirrup to the stirrup strap in the wrong orientation.

For these reasons, many riders prefer two-way stirrups. An example of a two-way safety stirrup of the prior art is disclosed in AU-26089/95. AU-26089/95 discloses a stirrup in which the rider's boot is held in a D-shaped restraint means which is pivotally mounted between two extremities of an inverted U-shaped mounting means. If the rider is dismounted from the horse, the restraint means pivots out of the normal position, one of the pivotal mountings releases from the mounting member, and the restraint means separates, thus releasing the foot from both the restraint and the inverted U-shaped mounting means.

One of the disadvantages of two-way stirrups of the prior art is that the restraint means can be pushed out of the normal position by the movement and pressure exerted by hard riding. The amount of forward pressure required to cause the safety stirrup to release is approximately the same as the amount of rearward pressure required to cause release. Professional riders such as jockeys, mountain cattlemen, rodeo riders, polo players and the like exert enormous pressure on stirrups as they pull up a horse or lean back to resist being thrown over the horse's head. The pressure of the rider's foot being pressed hard into the stirrup can cause a two-way stirrup to suddenly release, unbalancing the rider and potentially causing them to fall from the horse.

Typically, the safety stirrups of the prior art also have the disadvantages of being made of metal, and thus being relatively heavy, and of having relatively complicated construction. In general, the stirrups of the prior art comprise articulated members or complicated joints between members which separate when the rider is dismounted—the articulation and complicated construction contributing to the cost of construction.

SUMMARY OF THE INVENTION

It is an object of the present invention to provide a two-way safety stirrup that provides the desirable advantages of release in the event of the rider being dismounted, but which is less prone to unexpected release when pressure is applied in the forward direction. It is a further object to provide a safety stirrup that is of far simpler construction than stirrups of the prior art, yet is not as prone to unexpected release and which can be made of materials other than metal (such as plastics and polymers) so that the stirrups are more economical to manufacture and are of comparatively light weight.

Accordingly, the present invention provides a safety stirrup including:

a generally U-shaped mounting member, and a foot support member for receiving a rider's foot, such that when the rider's foot is in the normal use position, the foot support member is restrained by one or more mountings, wherein vertically upward movement of the rider's foot out of the normal use position causes the one or more mountings to release the foot support member sufficiently that the foot support member can move in the same direction as the rider's foot until the foot support member is fully disconnected from the U-shaped mounting member.

It is preferred but not essential that the mounting includes one or more projections. In a particularly preferred embodiment the present invention provides a safety stirrup including:

a generally U-shaped mounting member, and a foot support member for receiving a rider's foot, such that when the rider's foot is in the normal use position, the foot support member is retained by one or more mountings having projections, wherein during normal use the projections are located in recesses but vertically upward movement of the rider's foot out of the normal use position causes the one or more mountings to release the foot support member sufficiently that the foot support member can move in the same direction as the rider's foot until the foot support member is fully disconnected from the U-shaped mounting member, the projections moving in their respective recesses and rotating in the same direction as the rider's foot prior to the foot support member being fully disconnected from the U-shaped mounting member.

The term "normal use position" is used throughout the specification to denote the position of the riders foot in the stirrup when a rider is mounting or mounted on a horse to which the stirrup is fitted. When the rider's foot is in the normal use position, the U-shaped mounting member and the foot support are generally co-planar, or have parallel planes. During normal riding, the plane(s) is/are approximately vertical and the rider's foot is approximately perpendicular to the plane of the U-shaped mounting member, the toe pointing in the forward position and the heel oriented in the rearward direction.

The present invention makes use of the fact that when the rider's foot moves out of the normal in-use position, such as when the rider is dismounted, there is a vertical component to the movement of the rider's foot. Typically, the rider's foot will move upwards relative to the U-shaped member and then rotate, or just rotate, both movements including a significant vertical force component. In the safety stirrup of the present invention the vertical force component causes vertical movement of the foot support relative to the U-shaped member, such that the foot support is shifted into a position where it can move in the same forward or rearwards direction as the rider's foot until the foot support is fully disconnected from the U-shaped mounting member.

The generally U-shaped mounting member is typically in the shape of an inverted curve or takes the shape of three sides of a square or rectangle. Typically the foot support is D-shaped, and in normal use the sole of the rider's boot is adjacent the straight part of the D which comprises the footplate.

When there is one mounting it may be located on an arm of the U-shaped mounting member or alternatively it may be located on the foot support. When there are two mountings, they may each be located on an arm of the U-shaped mounting member. Alternatively, one mounting may be located on one arm of the U-shaped mounting member while the other mounting is located on the foot support. As another alternative, both mountings may be located on the foot support.

Typically the mounting includes one or more projections which can be received in complementary shaped recesses. The one or more projections may be located on the U-shaped mounting member and received in recesses in the foot support. Alternatively, the one or more projections may be located on the D-shaped foot support, and received in recesses in the U-shaped mounting member. In a particularly preferred embodiment, each projection is of generally cylindrical shape, or a boss of convenient cross section.

The complementary shaped recess or recesses may be of any convenient shape and depth, sufficient to retain the one or more projections and resist rotation of the foot support relative to the U-shaped mounting member when the stirrup is in normal use. Typically, in response to vertical force exerted by the rider's boot, the projection(s) moves in the recess(es) to a position which allows the D-shaped foot support to move in the same direction as the rider's foot.

For example, the recess(es) may be shaped to include an indentation in which the primary projection resides during normal use, and guide or passage along which the projection (s) may move in the forwards or rearwards direction in response to the force exerted by the rider's foot when the rider is dismounted.

The one or more mountings may include an additional projection locatable in a recess adjacent an end of the U-shaped member and footplate of the foot support. Typically the projection and additional projection are located on the same element (either the U-shaped mounting member or the foot support). In a particularly preferred embodiment, the projection and additional projection are located on the D-shaped foot support, and received in recesses in the U-shaped mounting member. Alternatively the projection may be located on different elements. In this embodiment, typically the projection is located on the foot support while the additional projection is located on the U-shaped mounting member.

In a particularly preferred embodiment, two additional projections are located on the D-shaped foot support and comprise a long neck and bulbous head, forming a "mushroom" shape. The necks are received in slot-shaped recess at either end of the U-shaped mounting member. Typically, in response to vertical force exerted by the rider's boot, the additional projection moves in the recess to a position which allows the D-shaped foot support to move in the same direction as the rider's foot. In this particular embodiment, it is preferred that the projection and additional projection are on the D-shaped foot support and are located in recesses in the U-shaped mounting member. In response to vertical movement of the rider's foot, the projection and additional projection move vertically upwards in their respective recesses. As the rider's boot rotates, the projection on the U-shaped mounting follows a curved passage in the recess, following the direction of rotation of the rider's boot, until the projection on the D-shaped foot support disengages from the U-shaped member. At the same time, the additional projection rotates in its recess and finally passes out through the slot shaped recess, thus completely disengaging the D-shaped foot support containing the rider's foot from the U-shaped mounting member.

The safety stirrup of the present invention has the advantage that the release characteristics can be adapted to the rider's skill level and the type of riding being carried out. For example, the projection and additional projection can be configured such that the rider's foot has to exert greater than normal force in either the forward or rearwards directions in order for the foot support to fully disconnect from the U-shaped mounting member. A professional rider who does hard riding and generally exerts a great deal of force on the stirrup could use a safety stirrup in which the projections fit deeply into the recesses so that a great deal of forward or backwards force would need to be imposed before the foot support could be fully disconnected from the U-shaped mounting member. For example, springs or other biasing means could be used to resist movement of the projection and/or additional projection in their recess. Alternatively, for a novice rider who is more likely to fall and less likely to exert a great deal of force on the stirrup, the recesses could be very shallow and shaped so that relatively less forward or backward pressure would be required to fully disconnect the foot support from the U-shaped mounting member.

Furthermore the shape of the projections and corresponding recess could be adapted so that it is easier to disengage the projection from the recess when force is exerted in the forward direction rather than the backward direction. However, as with one-way stirrups, this embodiment would only work properly if the stirrup were mounted on the saddle strap in the correct orientation.

The stirrup strap may be passed through the stirrup between the U-shaped member and the foot support. Alternatively the U-shaped member may be adapted for attachment of a stirrup strap using any conventional arrangement such as a slot in the U-shaped mounting member through which the strap can be threaded, or a bar around which the strap can be wrapped, or a known toggle-type connection.

Typically, the flat, straight section of the D-shaped foot support comprises a footplate against which the sole of the rider's boot rests during mounting or normal riding. The foot support can be in any convenient form, such as a bar, case plate or slotted plate that is oriented in a generally horizontal plane during normal use.

While the safety stirrup of the present invention could be manufactured out of metal, the design is sufficiently simple that it could be manufactured out of other convenient materials such as polymers or plastic, and composites such as carbon/graphite composites. Polymers and plastic provide weight advantages over metal, which is the traditional material of construction for stirrups. Furthermore, polymers, unlike most metals, have the ability to stretch and therefore easily redistribute load forces. Preferably, the safety stirrup of the present invention is formed by injection molding using a polymeric material which is sufficiently flexible to provide a biasing force which resists movement of the foot support member out of the normal use position.

The invention will now be further described with reference to the following drawings that depict non-limiting embodiments of the safety stirrup of the present invention.

BRIEF DESCRIPTION OF THE DRAWINGS

FIG. 1 includes plan views of several embodiment of the safety stirrup of the present invention in the normal in-use position. Specifically.

DETAILED DESCRIPTION OF THE INVENTION

Figure 1A:
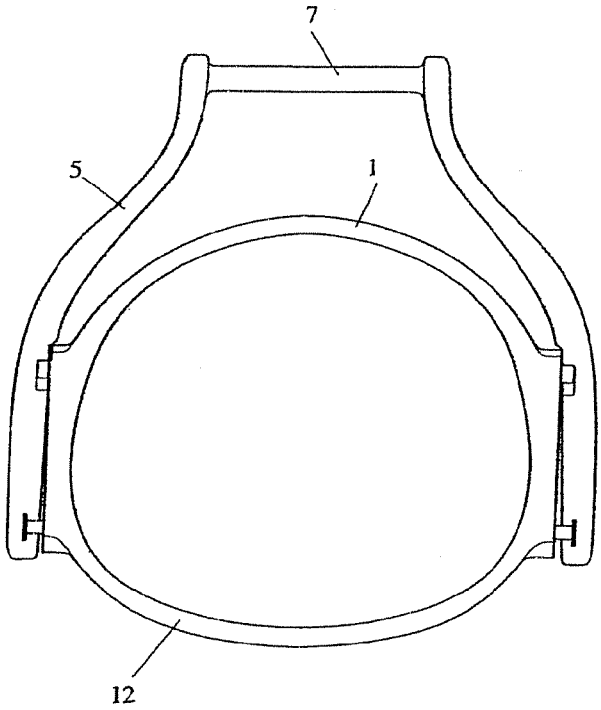
FIG. 1*a* is a plan view of one embodiment of the safety stirrup having two projections and two additional projections all located on the foot support.

FIG. 1*a* shows an inverted U-shaped mounting member (5) comprising a horizontal bar (7) to which the stirrup strap may be attached. Located within the U-shaped mounting member is a D-shaped foot support (1) for receiving a rider's foot, including a footplate (12) which rests against the sole of the rider's boot.

When the stirrup is in normal use, the foot support (1) lies in the same plane as the U-shaped mounting member (5) and is held in place by two mountings located on either side of the U-shaped mounting member. In the embodiment shown in FIG. 1*a*, the projections of the mountings and two additional projections are all located on the foot support (1).

Figure 1B:
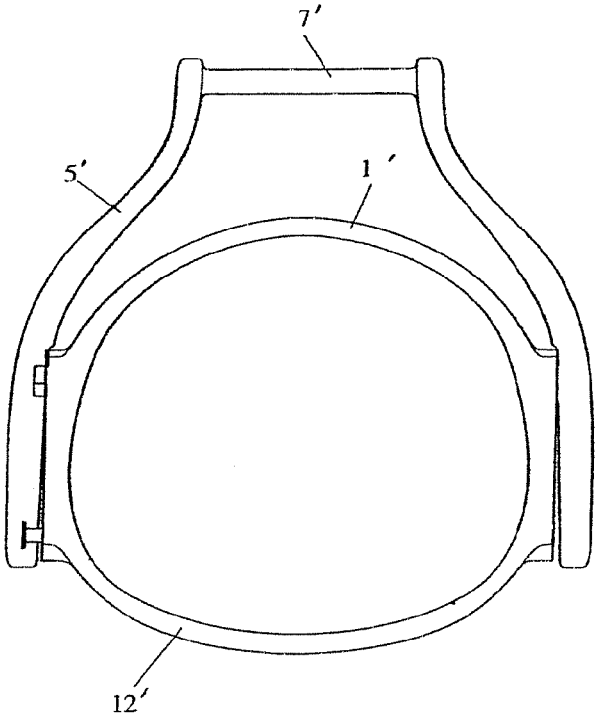
FIG. 1*b* is a plan view of one embodiment of the safety stirrup having one mounting and an additional projection located on the foot support.

FIG. 1*b* again shows an inverted U-shaped mounting member (5') comprising a horizontal bar (7'). Located within the U-shaped mounting member is a D-shaped foot support (1') including a footplate (12'). In this embodiment there is one mounting, the projection and additional projection being located on the foot support.

Figure 1C:
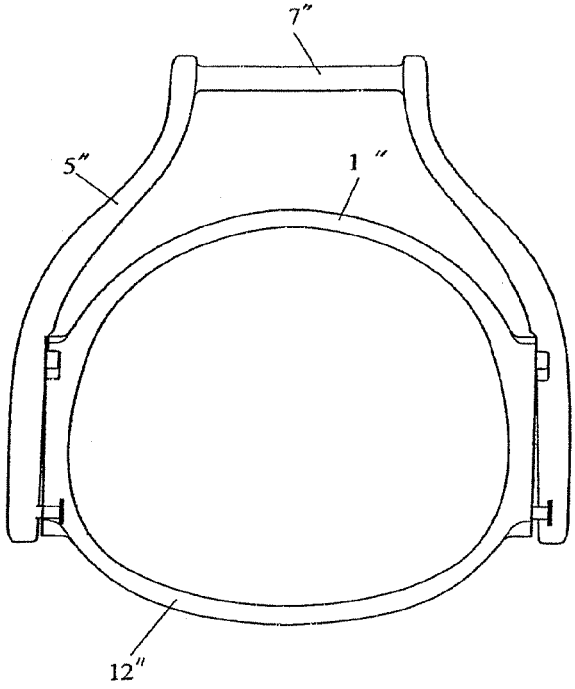
FIG. 1*c* is a plan view of one embodiment of the safety stirrup having one mounting and an additional projection located on the foot support plus another mounting and another additional projection located on the U-shaped mounting member.

FIG. 1*c* again shows an inverted U-shaped mounting member (5") comprising a horizontal bar (7"). Located within the U-shaped mounting member is a D-shaped foot support (1") including a footplate (12"). In this embodiment there are two mountings, one having a projection and additional projection located on the foot support while the other mounting has a projection and additional projection located on the U-shaped mounting member.

Figure 1D:
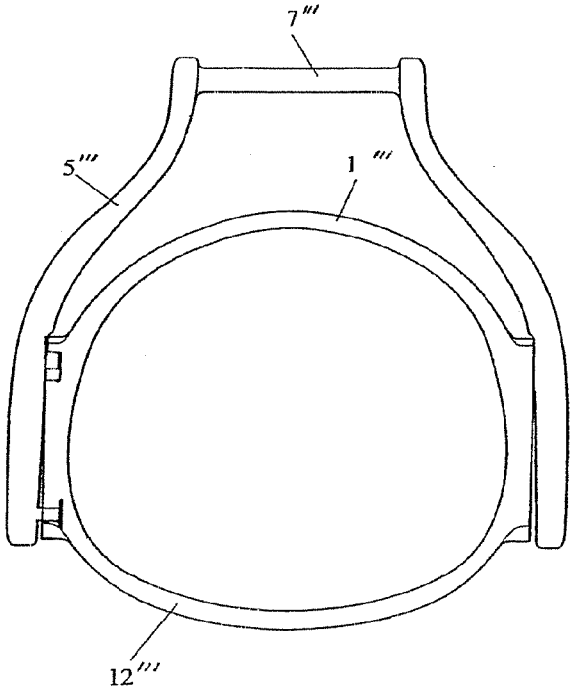
FIG. 1*d* is a plan view of one embodiment of the safety stirrup having one mounting and an additional projection located on one arm of the U-shaped mounting member.

FIG. 1*d* again shows an inverted U-shaped mounting member (5''') comprising a horizontal bar (7'''). Located within the U-shaped mounting member is a D-shaped foot support (1''') including a footplate (12'''). In this embodiment there is one mounting, the projection and additional projection being located on the U-shaped mounting member.

Figure 1E:
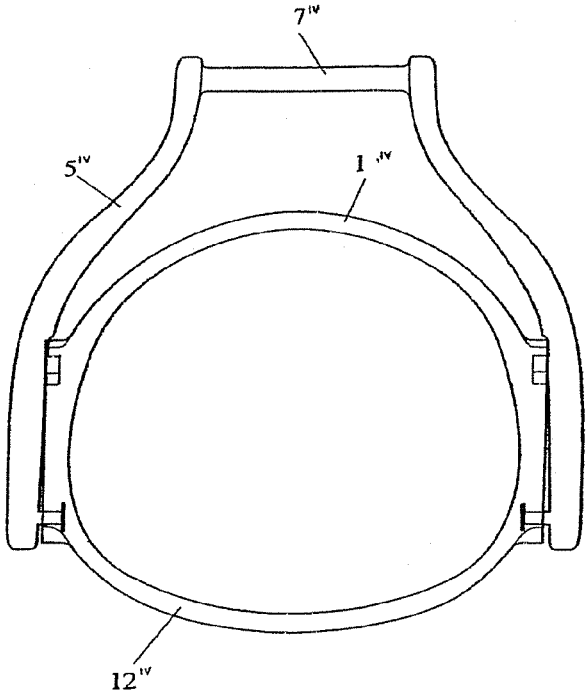
FIG. 1*e* is a plan view of one embodiment of the safety stirrup having a two mountings and two additional projections all located on the U-shaped mounting member.

FIG. 1*e* again shows an inverted U-shaped mounting member ($\mathbf{5}^{iv}$) comprising a horizontal bar ($\mathbf{7}^{iv}$). Located within the U-shaped mounting member is a D-shaped foot support ($\mathbf{1}^{iv}$) including a footplate ($\mathbf{12}^{iv}$). In this embodiment there are two mountings, each having a projection and additional projection all located on the U-shaped mounting member.

Figure 1F:
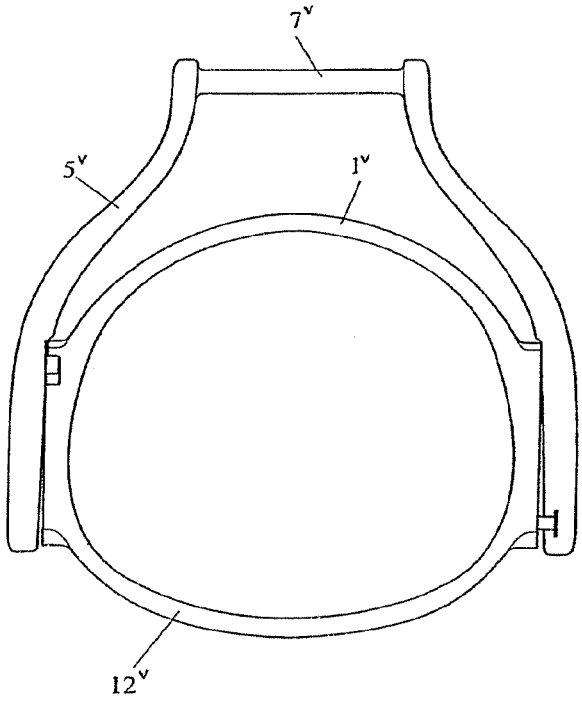
FIG. 1*f* is a plan view of one embodiment of the safety stirrup having one mounting comprising a projection located on the foot support and an additional projection located on the U-shaped mounting member.

FIG. 1*f* again shows an inverted U-shaped mounting member ($\mathbf{5}^{v}$) comprising a horizontal bar ($\mathbf{7}^{v}$). Located within the U-shaped mounting member ($\mathbf{5}^{v}$) is a D-shaped foot support ($\mathbf{1}^{v}$) including a footplate ($\mathbf{12}^{v}$). In this embodiment there is one mounting, the projection of the mounting being located on the foot support while the additional projection is located on the U-shaped mounting member.

Figure 2A:
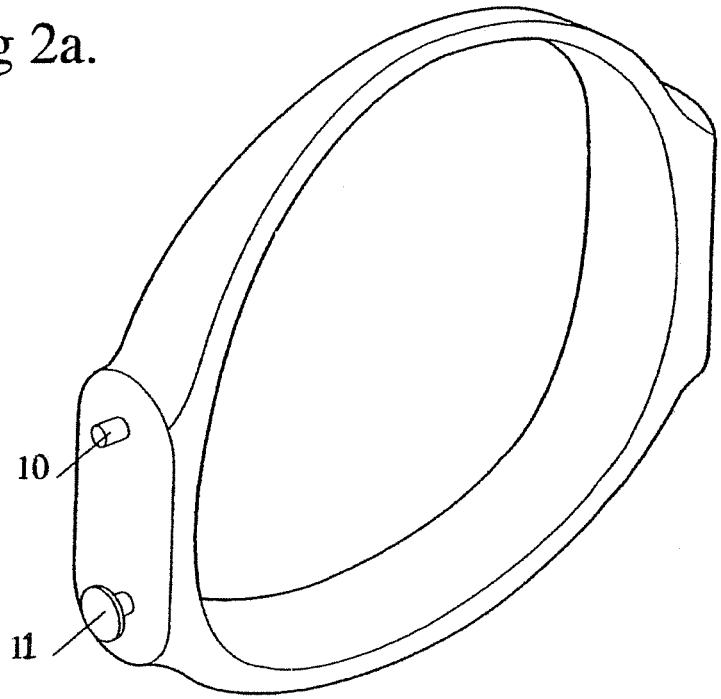
FIG. 2*a* is a perspective view towards the side of a D-shaped foot support of a safety stirrup having a mounting and additional projection on the foot support, such as, for example, the safety stirrup of FIG. 1*a*, 1*b* or 1*c*.

FIG. 2*a* is a perspective view towards a side of a D-shaped foot support on which is located a cylindrical shaped projection (10) and mushroom shaped additional projection (12). This mounting could, for example, be used in the embodiments depicted in FIGS. 1*a*, 1*b* or 1*c*.

Figure 2B:
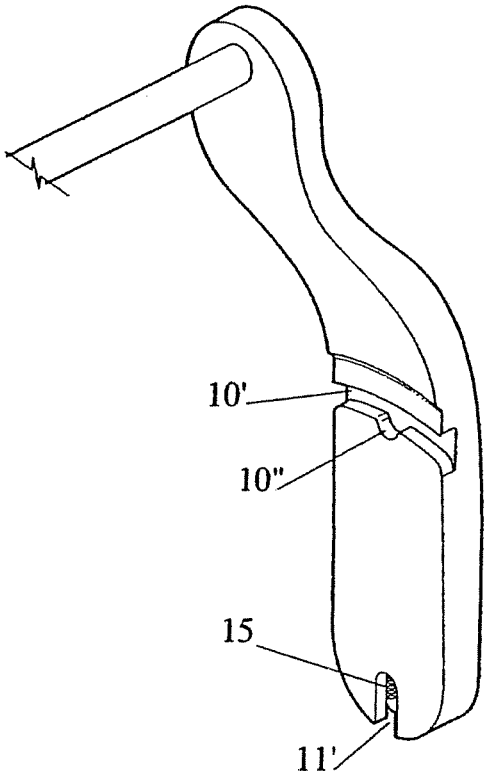
FIG. 2*b* is a view of the inside of one arm of the U-shaped mounting, suitable for receiving the mounting and additional projection of FIG. 2*a*.

FIG. 2*b* is a view of one arm of the U-shaped mounting member showing recesses (10', 11') for receiving the projection (10) and additional projection (11) of FIG. 2*a*. Recess (11') receives the mushroom shaped projection (11), the neck of the mushroom residing in the slot-shaped part of the recess. The head of the mushroom is located entirely within the U-shaped mounting member and is not visible when the stirrup is in normal use. A biasing means, in this case a spring (15), is located within the recess. Recess (10') receives the cylindrical shaped projection (10). In the event of the rider being dismounted, the rider's foot moves out of the normal in-use position. The vertical component of the force exerted by the rider's foot causes the primary projection to move out of the indentation (10") in which it rests, into the passage, or curved part of the recess. The amount of vertical force required will depend on the depth of the indentation. If the indentation is very shallow, the primary projection may almost roll or slide out into the passage. Simultaneously, the additional projection moves against the force exerted by the biasing means (15). As the rotation of the rider's foot increases, the projection follows the passage in the recess (10') in the direction of rotation until it leaves the passage and the projection is no longer in contact with the U-shaped mounting member. As this occurs, the additional projection (11) rotates in its recess (11') and when the primary projection (10) is free of the U-shaped mounting means, the additional projection (11) can move out of the recess (11'), thus completely disengaging the foot support from the U-shaped mounting means.

Figure 2C:
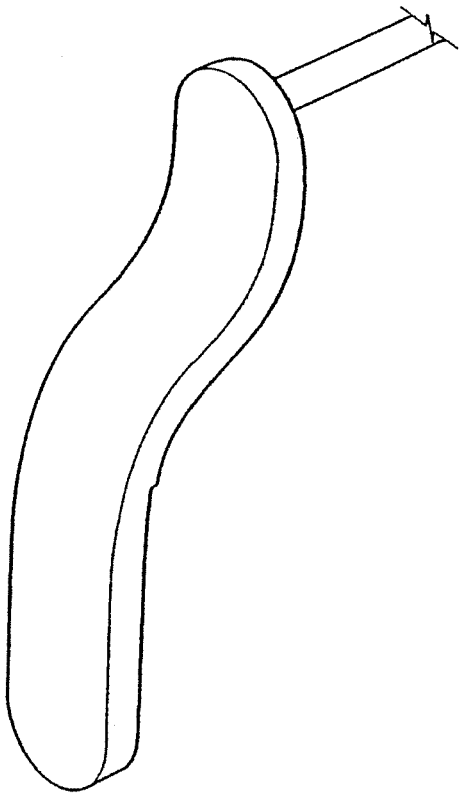
FIG. 2*c* is a view of the outer side of the arm depicted in FIG. 2*b*.

FIG. 2*c* shows the outer side of the arm depicted in FIG. 2*b*. In this view, it is clear that the primary and additional projections are not visible when the stirrup is in normal use.

Figure 3A:
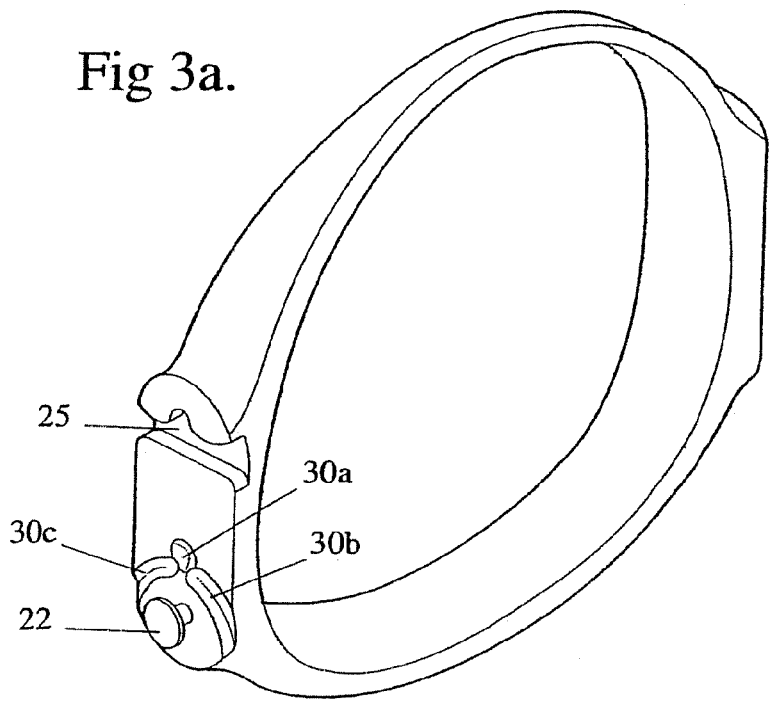
FIG. 3*a* is a perspective view towards the side of a D-shaped foot support of a further embodiment of the safety stirrup of the present invention.

FIG. 3*a* is a perspective view towards a side of a D-shaped foot support according to a further embodiment of the safety stirrup of the present invention. In this view, the mushroom shaped additional projection (22) can be seen. Above the additional projection is a discontinuous recess comprising an indentation (30*a*) and two passages (30*b*, 30*c*) for receiving a third projection on the D-shaped foot support. A recess (25) comprising an indentation and elongate passage for receiving a primary projection on the D-shaped foot support is also shown. Identical projections and recesses also exist on the other side of the foot support but cannot be seen in this view.

Figure 3B:
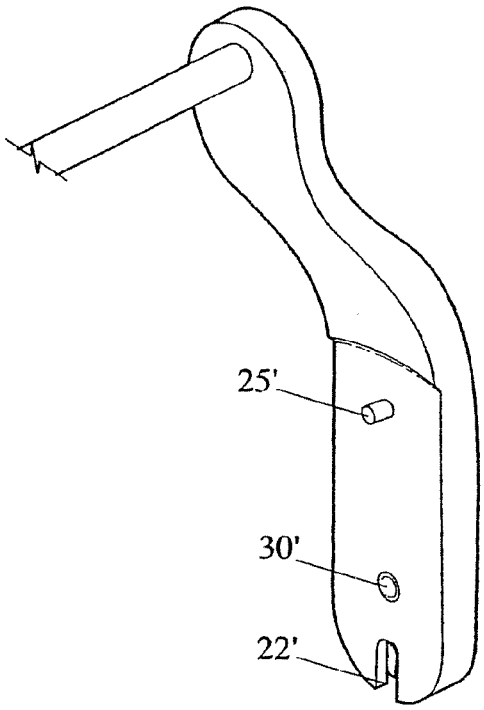
FIG. 3*b* is a view of the inside of one arm of the U-shaped mounting member of the further embodiment.

FIG. 3*b* is a view of one arm of the U-shaped mounting member of the further embodiment showing the projection (25') to be received in the recess (25) depicted in FIG. 3*a*. Recess (22') is for receiving the mushroom shaped additional projection (22) depicted in FIG. 3*a*, the neck of the mushroom residing in the slot-shaped part of the recess, the head of the mushroom being visible on the outside of the U-shaped member when the stirrup is in normal use. During normal use of the stirrup, a third projection (30') is located within the indentation (30*a*) depicted in FIG. 3*a*. In the event of the rider being dismounted, the rider's foot moves out of the normal in-use position. The vertical component of the force exerted causes the D-shaped foot support to move vertically upwards relative to the U-shaped support member, so that primary projection (25') moves out of the indentation in the recess (25) and into the elongate passage. Simultaneously, the additional projection (22) moves upwards in the recess (22'), the third projection (30') moving out of the indentation in the recess (30*a*) and into either passage 30*b* or 30*c*, depending on the direction of rotation of the D-shaped foot support. This movement of the third projection (30') is facilitated in part by flexing of the U-shaped member, which thus acts as a biasing means. As the rotation of the rider's foot increases, the primary projection (25') follows the moves along the recess (25) in the direction of rotation until it leaves the passage and the projection is no longer in contact with the U-shaped mounting member. As this occurs, the additional projection (22) rotates in its recess (22') and when the primary projection (25') is free of the U-shaped mounting means, the additional projection (22') can move out of the recess (22), thus completely disengaging the foot support from the U-shaped mounting means.

Figure 3C:
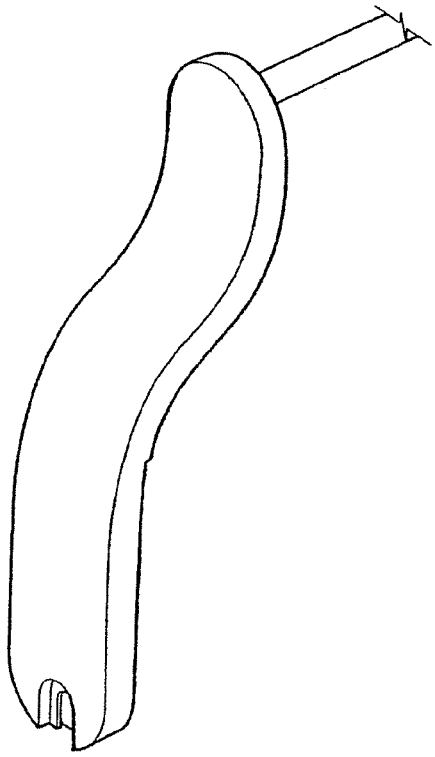
FIG. 3*c* is a view of the outer side of the arm depicted in FIG. 3*b*.

FIG. 3*c* shows the outer side of the arm depicted in FIG. 3*b*. In this view, it is clear that the head of the mushroom shaped additional projection would be visible when the stirrup is in normal use.

Figure 4:
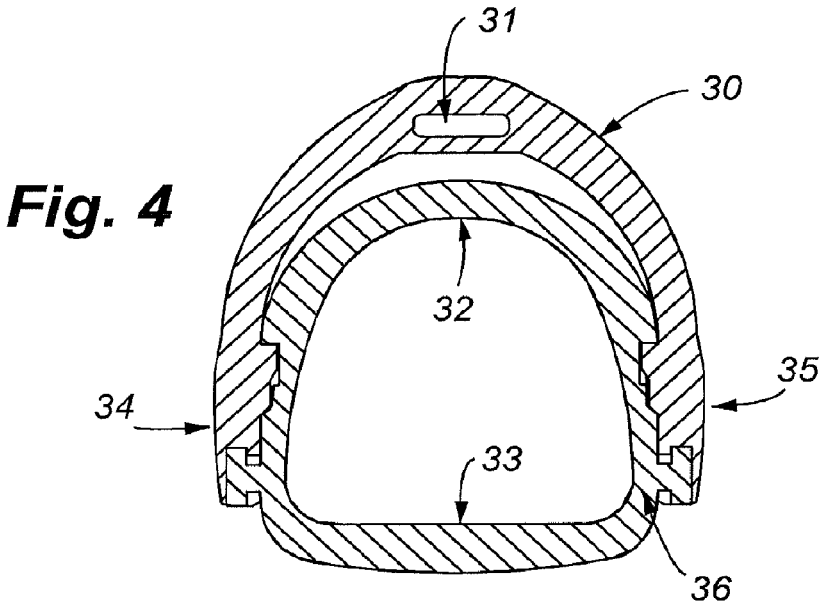
FIG. 4 shows a preferred embodiment of the present invention including an inverted U-shaped mounting member.

FIG. 4 shows a preferred embodiment of the present invention including an inverted U-shaped mounting member (30) including a slot (31) adapted to receive a stirrup strap. Located within the U-shaped mounting member (30) is a D-shaped foot support (32) including a flat footplate (33). In this embodiment, there are two mountings (34 and 35); one on each side of the U-shaped mounting member (30). Each of these mountings (34 and 35) include a first, mushroom-shaped projection (36) attached to and extending from the D-shaped foot support (32). Additionally, these mountings (34 and 35) include a second projection extending from the U-shaped mounting member (30) and residing in recesses formed in the outside surface of the D-shaped foot support (32).

Figure 5A:
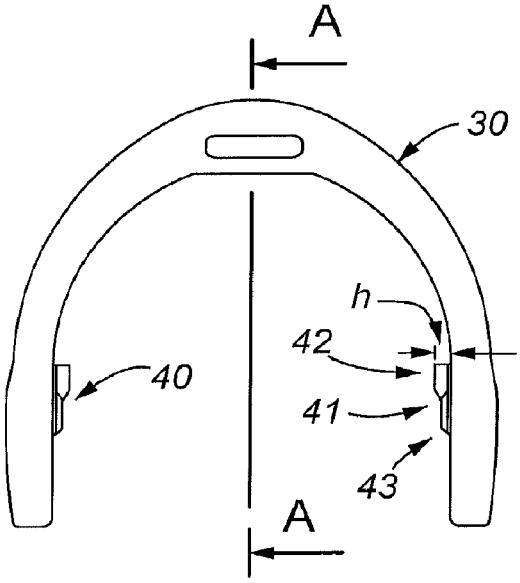
FIG. 5*a* is a front view of the U-shaped mounting member of the embodiment depicted in FIG. 4.
Figure 5B:
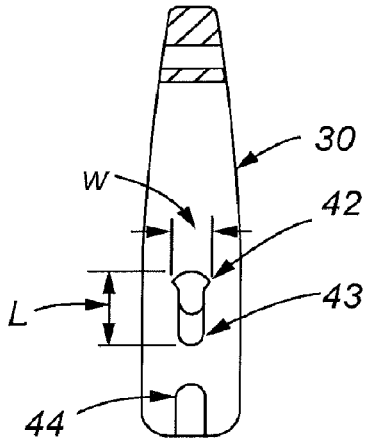
FIG. 5*b* is a sectional view of the U-shaped mounting member of FIG. 5*a* along sectional line A-A.

FIG. 5*a* shows a front view of the U-shaped mounting member (30) of the embodiment depicted in FIG. 4 and described above. In this figure, the second projections (40 and 41) that compose part of the mountings are visible near the ends of the U-shaped mounting member (30), positioned to be received in corresponding recesses in the D-shaped foot support. The shape of these second projections is depicted in FIG. 5*b*, which is a sectional view of the U-shaped mounting member (30) of FIG. 5*a* along sectional line A-A. As depicted in FIGS. 5*a* and 5*b*, these second projections have a first end (42) and a second end (43). While the width (w) of the second projection may be continuous throughout the length, the preferred second projection depicted in FIG. 5*b*, has a discontinuous width along the length of the projection such that the width at the first end (42) is not equal to the length at the second end (43). The second projection of the embodiment depicted in FIG. 5*b* is wider at the first end (42) than at the second end (43). Additionally, the height (h) of these second projections as they extend from the surface of the U-shaped mounting member (30) may be continuous or variable along the length of the second projections. The preferred second projection depicted in FIG. 5*a*, has a discontinuous height along the length of the projection such that the height at the first end (42) is not equal to the height at the second end (43). The second projection of the embodiment depicted in FIG. 5*a* has a greater height (h) at the first end (42) than at the second end (43). The surface of the second projections may be contoured along the length of the projections (L) to match contours in corresponding recesses in the D-shaped foot support. A slot (44) is present in each end of the U-shaped mounting member (30) to receive a mushroom-shaped projection from the D-shaped foot support. The slot (44) is open to the bottom of the U-shaped mounting member (30) allowing a projection lodged in the slot (44) to rotate in the slot (44) and to be completely removed from the slot (44) through the bottom of an arm of the U-shaped mounting member (30).

In the preferred embodiment of the U-shaped mounting member (30) depicted in FIGS. 5*a* and 5*b*, the second projections (40 and 41) control the rotation of the D-shaped foot support relative to the U-shaped mounting member (30) around an axis defined by a projection extending from the D-shaped foot support and lodged in the slot (44). The height (h), width (w) and length (L) of the projections (40 and 41) may be varied as desired to control the force required to move the D-shaped foot support in a horizontal and/or vertical direction, relative to the U-shaped mounting member (30). Similarly, the height (h), width (w) and length (L) of the projections (40 and 41) may be varied as desired to control the force required to rotate the D-shaped foot support, relative to the U-shaped mounting member (30) around an axis defined by a projection extending from the D-shaped foot support and lodged in the slot (44).

Figure 6A:
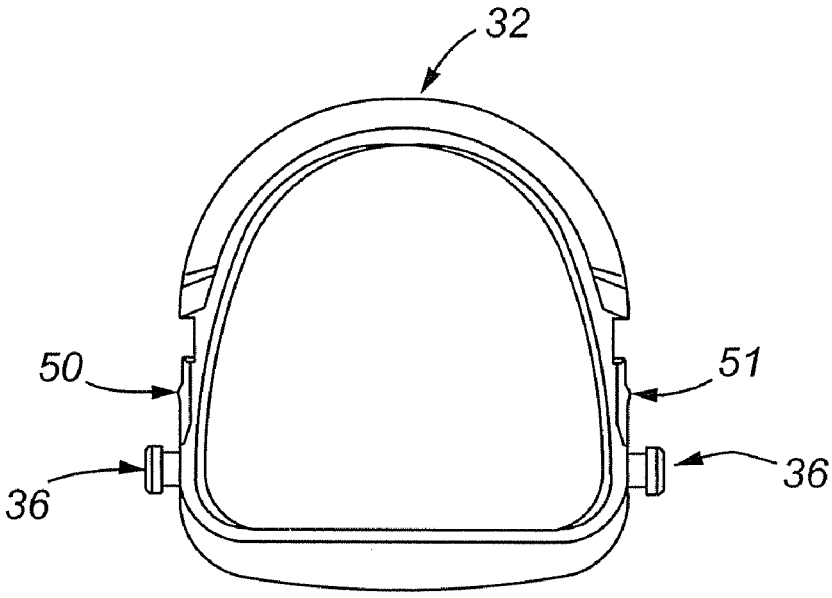
FIG. 6*a* shows a preferred embodiment of a D-shaped foot support of the present invention.
Figure 6B:
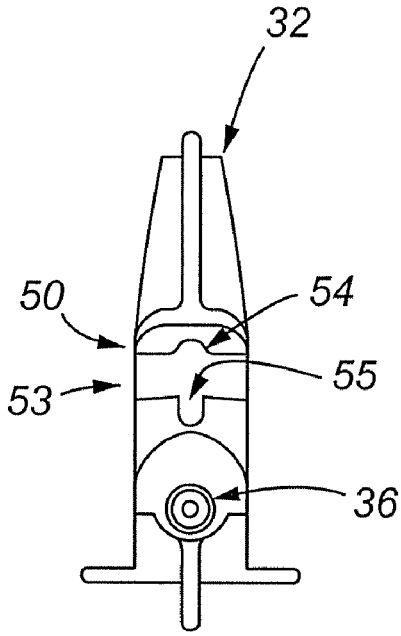
FIG. 6*b* is a side view of the D-shaped foot support depicted in FIG. 6*a*.

A preferred embodiment of the D-shaped foot support (32) is depicted in FIGS. 6*a* and 6*b*. In this embodiment, the D-shaped foot support (32) includes two mushroom-shaped projections (36) attached to and extending from each side of the D-shaped foot support (32). Additionally, the D-shaped foot support (32) of this embodiment includes a two recesses (50 and 51) on each side of the D-shaped foot support (32) specifically adapted to accommodate the second projections (40 and 41 of FIGS. 5*a* and 5*b*) on the U-shaped mounting member.

FIG. 6*b* shows a side view of the D-shaped foot support (32) depicted in FIG. 6*a*. As shown in FIG. 6*b*, the recess (50) includes a central channel (53) adapted to accommodate the projection (40 of FIG. 5B) extending from the U-shaped mounting member while allowing rotation of the D-shaped foot support around the mushroom shaped projections (36) relative to the U-shaped mounting member. One side of the central channel (53) has a lower indentation (55) that is of a width that will accommodate the width of the projection (40 of FIG. 5B) extending from the U-shaped mounting member. The opposite side of the central channel (53) has an upper indentation (54), opposite the lower indentation (55) similarly adopted to accommodate the width of the projection (40 of FIG. 5B) extending from the U-shaped mounting member.

During normal use of the safety stirrup depicted in FIGS. 4-6*b*, the D-shaped foot support is held in place in the U-shaped mounting member by the two mushroom-shaped projections lodged in the slots at the ends of the U-shaped mounting member while the second projections reside in the upper indentations in the central channel of the recesses in the sides of the D-shaped foot support. While the mushroom-shaped projections hold the D-shaped foot support positioned within the U-shaped mounting member as depicted in FIG. 4, the positioning of the second projections in the upper indentations of the recesses on the sides of the D-shaped foot support holds the D-shaped foot support in a generally co-planar position with respect to the U-shaped mounting member. During normal use, the weight of a rider is supported against the flat, bottom portion of the D-shaped foot support by the second projections pressing against the upper indentation in the recesses of the D-shaped foot support. The safety stirrup is preferably constructed of a polymeric material which is sufficiently flexible to provide a biasing force which resists movement of the second projections in the recesses on the sides of the D-shaped foot support.

In the instance of an unintended dismount, the rider's foot moves the D-shaped foot support in an upward vertical direction relative to the U-shaped mounting member, causing the second projections residing in the upper indentations in the recesses in the D-shaped foot support to move vertically downwards relative to the D-shaped foot support and into the lower indentation in the recesses on the sides of the D-shaped foot support. This releases the second projections to move within the central channel of the recesses on the sides of the D-shaped foot support. The D-,shaped foot support may then rotate about the axis defined by the mushroom shaped projections on the sides of the D-shaped foot support until the second projections have rotated completely out of the central channels of the recesses on the sides of the D-shaped foot support. When the second projections have rotated out of the central channels, the D-shaped foot support can detach from the U-shaped mounting member as the mushroom-shaped projections slide out of the slots on the ends of the U-shaped mounting member, thereby releasing the rider's foot from the U-shaped mounting member strapped to a saddle.

While the foregoing describes preferred embodiments of the invention, various modifications can be included without departing from the spirit and scope of the invention.

What is claimed is:

1. A safety stirrup comprising:

a generally U-shaped mounting member comprising (i) at least two mountings, one on each side of the generally U-shaped mounting member, and (ii) at least two secondary projections, one on each side of the generally U-shaped mounting member, and a generally D shaped foot support member that extends around a rider's foot comprising (i) at least two primary projections which are releasably received within complementary shaped primary recesses in the at least two mountings, (ii) at least two complementary shaped second recesses to releasably receive the secondary projections, and (iii) a central channel adapted to accommodate the at least two secondary projections, wherein when the rider's foot is in the normal use position, the foot support member is supported within the generally U-shaped mounting member by the at least two mountings comprising a releaseable connection between the generally U-shaped mounting member and the foot support member, wherein when the rider's foot is in the normal use position, the foot support member is supported in a generally co-planer position with respect to the generally U-shaped mounting member, and wherein vertically upward movement of the rider's foot out of the normal use position causes vertically upward movement of the foot support member such that the at least two mountings release the foot support member sufficiently that the foot support member can rotate in either direction until the foot support member is fully disconnected from the U-shaped mounting member.

2. A safety stirrup according to claim 1 comprising a biasing means to resist movement of the at least two primary projections in respective primary recesses.

3. A safety stirrup according to claim 1, which is constructed of a polymeric material which is sufficiently flexible to provide a biasing force which resists movement of the at least two secondary projections in their respective secondary recesses.

4. A safety stirrup according to claim 1, wherein the at least two primary projections are mushroom-shaped.

5. A safety stirrup according to claim 1, wherein the at least two secondary projections have a discontinuous width along the length of the projection.

6. A safety stirrup according to claim 1, wherein the at least two secondary projections have a discontinuous height along the length of the projection.

7. A safety stirrup according to claim 1, wherein the at least two secondary projections are contoured along their length to match corresponding contours in the at least two complementary shaped secondary recesses.

8. A safety stirrup according to claim 1, wherein the at least two secondary projections control the rotation of the D-shaped foot support relative to the U-shaped mounting member around an axis defined by the at least two primary projections when received within the complementary shaped primary recesses in the at least two mountings.

9. A safety stirrup according to claim 1, wherein vertically upward movement of the rider's foot out of the normal position causes vertically upward movement of the foot support member relative to the generally U-shaped mounting member, which causes the at least two secondary projections to move vertically downwards relative to the D-shaped foot support and releases the at least two secondary projections so that the D-shaped foot support may then rotate about the axis defined by the at least two primary projections until the at least two secondary projections have rotated completely out of the secondary recesses on the sides of the D-shaped foot support, enabling subsequent release of the at least two mountings.

* * * * *